US007879152B2

(12) United States Patent
Lee

(10) Patent No.: US 7,879,152 B2
(45) Date of Patent: Feb. 1, 2011

(54) APPARATUS AND METHOD FOR CLEANING NOZZLE

(75) Inventor: Joong Mok Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1259 days.

(21) Appl. No.: 11/472,847

(22) Filed: Jun. 22, 2006

(65) Prior Publication Data

US 2007/0151577 A1 Jul. 5, 2007

(30) Foreign Application Priority Data

Dec. 29, 2005 (KR) ..... 10-2005-0133113

(51) Int. Cl.
*B08B 9/00* (2006.01)
*B08B 9/023* (2006.01)
*B08B 3/10* (2006.01)
*B08B 1/00* (2006.01)

(52) U.S. Cl. ..... 134/6; 134/18

(58) Field of Classification Search ..... 134/6, 134/10, 18

See application file for complete search history.

(56) References Cited

U.S. PATENT DOCUMENTS 3,654,654 A * 4/1972 Abreu et al. ..... 15/1.51
4,230,067 A * 10/1980 Iwamoto et al. ..... 118/104
2003/0230634 A1* 12/2003 Heide et al. ..... 239/10

FOREIGN PATENT DOCUMENTS

JP 2003248010 A * 9/2003

* cited by examiner

*Primary Examiner*—Michael Barr
*Assistant Examiner*—Natasha Campbell
(74) *Attorney, Agent, or Firm*—Brinks Hofer Gilson & Lione

(57) ABSTRACT

Disclosed are an apparatus and a method for cleaning a nozzle, which can automatically clean pollutant of the nozzle. The nozzle cleaning apparatus comprises the nozzle in a polluted state, a nozzle cleaning unit to clean a pollutant material from the nozzle by use of an absorbing member, and an absorbing member cleaning unit to clean a pollutant material from the absorbing member. With this configuration, the nozzle cleaning apparatus can clean the polluted nozzle by use of the absorbing member and in turn, can clean the polluted absorbing member by use of cleaning liquid, whereby automatic cleaning of the nozzle can be accomplished. Automatic cleaning of the polluted nozzle has the effect of reducing cleaning labor and time, and improving productivity.

5 Claims, 6 Drawing Sheets

APPARATUS AND METHOD FOR CLEANING NOZZLE

FIELD OF THE INVENTION

This application claims the benefit of Korean Patent Application No. P05-133113, filed on Dec. 29, 2005, which is incorporated herein by reference.

BACKGROUND OF THE INVENTION

The present invention relates to a nozzle cleaning apparatus, and more particularly, to an apparatus and method for cleaning a nozzle for automatically cleaning pollutant of the nozzle.

Recently, a variety of flat panel displays, which are capable of solving heavy weight and bulky volume problems of cathode ray tubes, has been developed. Examples of the flat panel displays include a liquid crystal display (LCD) device, a field emission display (FED), a plasma display panel (PDP), and a light emitting display (LED).

Among the variety of flat panel displays, the LCD devices are designed to display images by regulating light transmissibility of liquid crystals using electric fields. These LCD devices include liquid crystal panels, in which liquid crystal cells are arranged in a matrix form, and drive circuits which drive the liquid crystal panels.

The liquid crystal panels are provided with common electrodes and pixel electrodes to apply an electric field to each of the liquid crystal cells. Conventionally, the pixel electrodes are formed on a lower substrate at positions of the respective liquid crystal cells. On the other hand, the common electrodes are integrally formed over a surface of an upper substrate. Each of the pixel electrodes is connected to a thin film transistor (hereinafter, referred to as "TFT") that is used as a switch device. The pixel electrodes are used to drive the liquid crystal cells along with the common electrodes in accordance with data signals supplied through the TFTs.

Generally, a method for manufacturing the liquid crystal panel comprises a substrate cleaning process, a substrate patterning process, an alignment film forming process, and a substrate assembling/liquid crystal forming process.

In the substrate cleaning process, foreign substances on first and second substrates are removed by use of cleaning agents prior to and after patterning the first and second substrates.

The substrate patterning process is divided into a first substrate patterning and a second substrate patterning. The first substrate is formed with color filters, common electrodes, and black matrices, and the second substrate is formed with a variety of signal lines including data lines and gate lines. The TFTs are formed at positions where the data lines and the gate lines intersect. The pixel electrodes are formed at pixel regions between the data lines and the gate lines. In the substrate patterning process, a photolithography method using a photoresist is generally used for the patterning of each layer.

In the alignment film forming process, first, alignment films are applied to both the first and second substrates, and then, the applied alignment films are rubbed via a rubbing process.

The substrate assembling/liquid crystal forming process includes a process for assembling the first and second substrates using a seal, a process for injecting liquid crystals, and a process for sealing a liquid crystal injection hole, these processes being performed in this sequence. Alternatively, the substrate assembling/liquid crystal forming process may include a seal process for forming a seal on the first substrate or second substrate, a loading process for loading liquid crystals on the substrate formed with the seal, and a process for assembling the first and second substrates to each other, these processes being performed in this sequence. Here, the liquid crystals are formed in a liquid crystal space, which is defined between the first and second substrates by ball spacers or column spacers.

The photolithography method, which is used in the substrate patterning process included in the manufacture of the liquid crystal panel to pattern each layer including the TFTs and signal lines, includes a coating process for coating a photoresist on the substrate, an exposure process for selectively irradiating light on the photoresist by use of a photo mask, and a developing process for developing the exposed photoresist.

In the coating process, the photoresist is coated on the substrate in accordance with rotation of a rotary chuck.

As shown in FIG. 1, a conventional rotary type photoresist coating apparatus includes a rotary chuck 10 to be mounted in a rotary cup (not shown), a substrate 20 loaded on the rotary chuck 10, and a nozzle 30 to dispense a photoresist 32 onto the substrate 20 through an outlet thereof.

The rotary chuck 10 is adapted to rotate by a driving shaft 12, which cooperates with a drive device (not shown), while supporting the substrate 20 which is loaded thereon from an external station.

The substrate 20 has a layer to be patterned via the photolithography method.

The nozzle 30 is designed to receive the photoresist 32 supplied from an external photoresist source, so as to dispense the photoresist 32 onto the substrate 20 in the form of droplets.

In operation of the conventional rotary type photoresist coating apparatus, if the substrate 20 is loaded on the rotary chuck 10, the photoresist 32 is dispensed in the form of droplets on the substrate 20 through the nozzle 30. Then, the rotary chuck 10 is rotated along with the rotary cup, whereby the photoresist 32, dispensed on the substrate 20, is spread and coated over a surface of the substrate 20.

A problem of the conventional rotary type photoresist coating apparatus is that the greater the use frequency of the nozzle 30, the more likely some of the photoresist 32 may accumulate at the outlet and surface of the nozzle 30, resulting in nozzle pollution.

The conventional rotary type photoresist coating apparatus, however, has no cleaning device to clean pollutant of the nozzle 30, and therefore, requires a skilled person to frequently clean the pollutant of the nozzle 30 by use of a wiper with a thinner.

Accordingly, the conventional rotary type photoresist coating apparatus suffers from troublesome manual operation for cleaning the pollutant of the nozzle 30, and therefore, results in consumption of labor and increased cleaning time.

SUMMARY OF THE INVENTION

The present invention is directed to an apparatus and method for cleaning a nozzle that substantially obviate one or more problems due to limitations and disadvantages of the related art.

An objective of the present invention is to provide an apparatus and method for cleaning a nozzle for automatically cleaning pollutant of the nozzle.

Additional advantages, objectives, and features of the invention in part will be set forth in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

An apparatus is provided for cleaning a nozzle in a polluted state. The apparatus comprises the nozzle. A nozzle cleaning unit cleans a pollutant material from the nozzle by use of an absorbing member. An absorbing member cleaning unit is provided to clean a pollutant material from the absorbing member.

In one embodiment, the nozzle cleaning unit may include a lift that can be raised and lowered and a first driving unit to raise and lower the lift. A driving shaft is connected to the absorbing member and adapted to horizontally move the absorbing member in accordance with operation of a second driving unit.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiment of the present invention, an example of which is illustrated in the accompanying drawings. Wherever possible, the same reference numbers will be used throughout the drawings to refer to the same or like parts.

Figure 1:
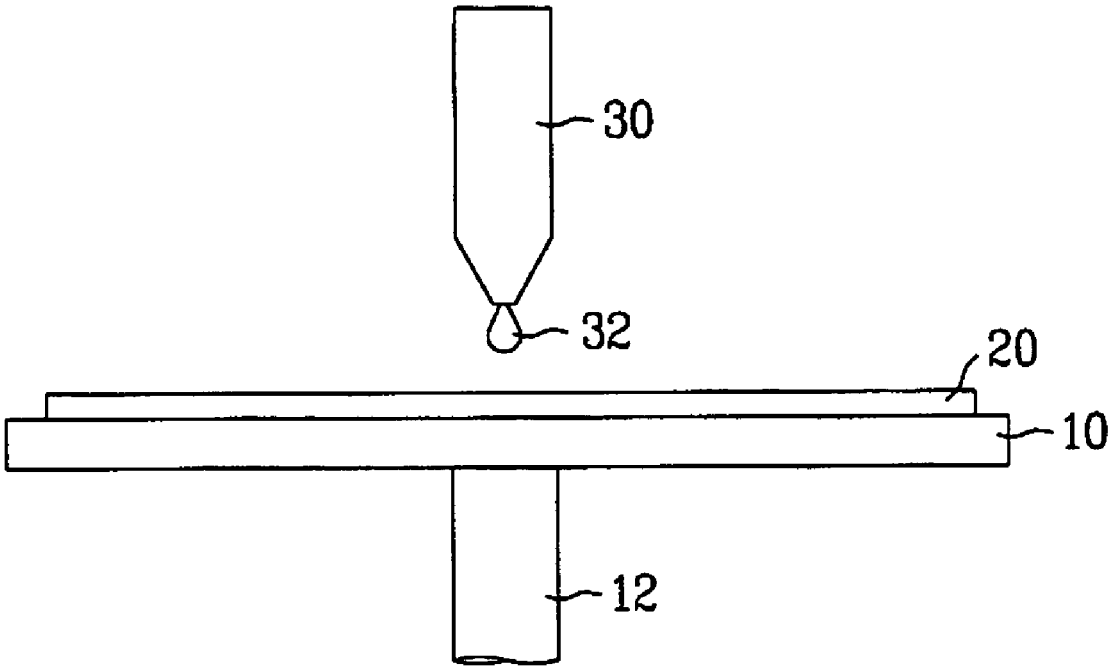
FIG. 1 Related Art
FIG. 1 is a schematic view illustrating a conventional rotary type coating apparatus.
Figure 2:
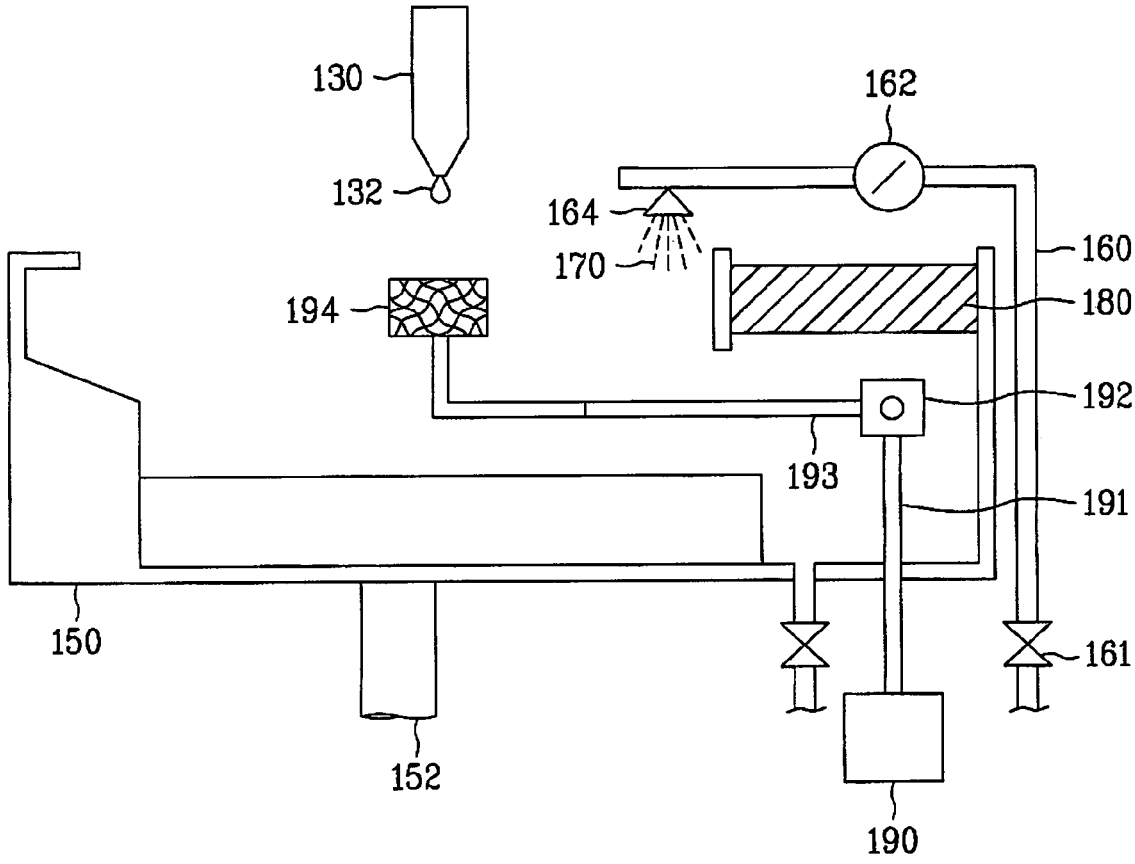
FIG. 2 is a schematic view illustrating a nozzle cleaning apparatus in accordance with an embodiment of the present invention.

FIG. 2 is a schematic view illustrating a nozzle cleaning apparatus in accordance with an embodiment of the present invention.

Referring to FIG. 2, the nozzle cleaning apparatus in accordance with the embodiment of the present invention includes a nozzle 130 which is in a polluted state, a gantry 150 configured to store and discharge a pollutant material 132 removed from the nozzle 130, a nozzle cleaning unit mounted in the gantry 150 to clean the pollutant material 132 from the nozzle 130 by use of an absorbing member 194, and an absorbing member cleaning unit to clean pollutant of the absorbing member 194.

When the nozzle 130 is used in a rotary type coating apparatus, it is transferred to a position above the gantry 150 after dispensing a photoresist onto a substrate. Otherwise, when the nozzle 130 is used in a dispensing apparatus, it is transferred to the position above the gantry 150 after dispensing a sealant onto a substrate. Accordingly, the photoresist or sealant inevitably accumulates at and around an outlet of the nozzle 130, to form the pollutant material 132 from the nozzle 130. Meanwhile, when the nozzle 130 used in the rotary type coating apparatus is cleaned by the nozzle cleaning unit, the rotary type coating apparatus operates to coat the photoresist over a surface of the substrate.

The gantry 150 has a driving shaft 152, such that the gantry 150 is moved from a home position to the nozzle 130 or vice versa when the driving shaft 152 is operated by a driving device (not shown). The gantry 150 further has a storage space for storing the pollutant material 132, which is removed from the nozzle 130 by the absorbing member 194, and a discharge pipe for discharging the pollutant material 132 stored in the storage space.

The nozzle cleaning unit includes a first driving unit 190, a lift 191 to cooperate with the first driving unit 190, a second driving unit 192 mounted on the lift 191, and a driving shaft 193 to cooperate with the second driving unit 192 so as to move the absorbing member 194.

The first driving unit 190 operates to raise and lower the lift 191.

The lift 191 serves to raise and lower the second driving unit 192 as it is operated by the first driving unit 190, thereby causing vertical movement of the absorbing member 194.

The second driving unit 192 is mounted at an upper end of the lift 191, and is used to move the driving shaft 193 to the absorbing member cleaning unit or the nozzle 130. That is, the second driving unit 192 operates to extend or contract the length of the driving shaft 193, whereby the absorbing member 194 is transferred between the nozzle 130 and the absorbing member cleaning unit.

The absorbing member 194 is made of sponge, and is mounted at an end of the driving shaft 193. The absorbing member 194 is brought into contact with the nozzle 130 when the lift 191 is raised, thereby serving to clean the pollutant material 132 at and around the outlet of the nozzle 130. In this case, the absorbing member 194 is repeatedly brought into contact with the nozzle 130 as the lift 191 is raised and lowered and also, as the driving shaft 193 performs a predetermined horizontal reciprocating motion, to clean the pollutant material 132 from the nozzle 130. That is, the absorbing member 194 is able to be moved vertically and horizontally to be brought into contact with the nozzle 130 in accordance with operations of the first and second driving units 190 and 192, thereby acting to clean the pollutant material 132 from the nozzle 130.

The absorbing member cleaning unit includes a compression block 180 mounted at a wall surface of the gantry 150, and a cleaning liquid injection pipe 164 to inject cleaning liquid 170 onto the absorbing member 194.

The compression block 180 is mounted at the wall surface of the gantry 150 to face the absorbing member 194. The compression block 180 serves to compress the absorbing member 194 if the absorbing member 194 is brought into contact with the compression block 180. Thus, the driving shaft 193 of the nozzle cleaning unit operates to move the absorbing member 194 after the absorbing member 194 is used to clean the pollutant material 132 from the nozzle 130, such that the absorbing member 194 is compressed by the compression block 180.

The cleaning liquid injection pipe 164 is connected perpendicular to a cleaning liquid supply pipe 160, which is mounted adjacent to the gantry 150. Here, the cleaning liquid 170 may be a volatile material including gasoline, thinner, or alcohol.

The cleaning liquid injection pipe 164 is provided with a flow-meter 162 to measure the flow rate of the cleaning liquid 170 supplied thereinto. The cleaning liquid supply pipe 160 is provided with a valve 161 to control the supply of the cleaning liquid 170. The valve 161 is opened at a time when the polluted absorbing member 194 comes into contact with the compression block 180, to supply the cleaning liquid 170 into the cleaning liquid injection pipe 164, whereby the cleaning liquid injection pipe 164 is able to inject the cleaning liquid 170 onto the polluted absorbing member 194.

As stated above, the absorbing member cleaning unit injects the cleaning liquid 170 onto the polluted absorbing member 194 through the cleaning liquid injection pipe 164 when the polluted absorbing member 194 comes into contact with the compression block 180. After being brought into contact with the compression block 180, the polluted absorbing member 194 is further moved by the driving shaft 193 of the nozzle cleaning unit, to be compressed by the compression block 180, whereby the polluted absorbing member 194 is able to be cleaned by the cleaning liquid 170 injected thereto. Compressing the polluted absorbing member 194 enables pollutant of the absorbing member 194, i.e. polluted cleaning liquid (not shown), to be discharged from the absorbing member 194. The discharged polluted cleaning liquid is first stored in the storage space of the gantry 150, and then, is discharged to the outside through the discharge pipe of the gantry 150.

FIGS. 3A to 3D are schematic views illustrating the sequential processes of a nozzle cleaning method in accordance with the embodiment of the present invention.

Figure 3A:
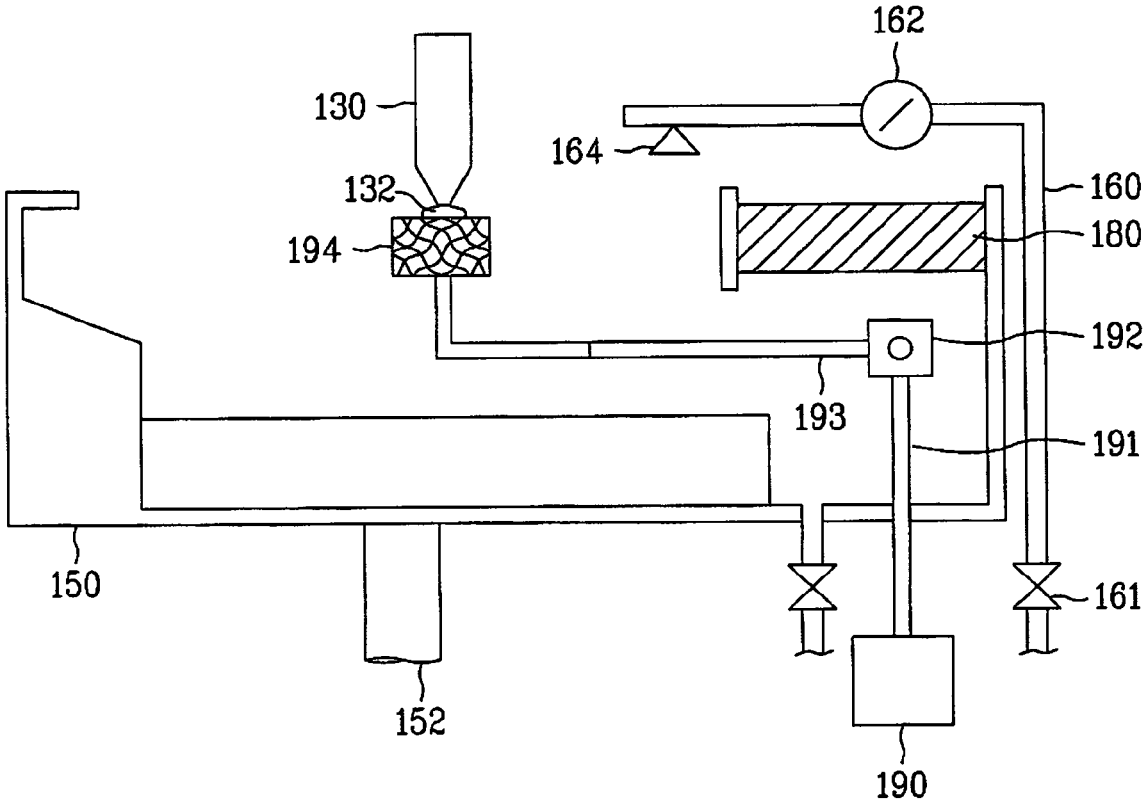
FIGS. 3A to 3D are schematic views illustrating sequential processes of a nozzle cleaning method in accordance with the embodiment of the present invention.

Referring to FIG. 3A, first, when the polluted nozzle 130 is moved toward the gantry 150 and located in the gantry 150, the position of the nozzle 130 is sensed by a sensor (not shown). Thereby, the first and second driving units 190 and 192 of the nozzle cleaning unit are operated based on signals transmitted from the sensor, to locate the absorbing member 194 underneath an end of the polluted nozzle 130. In this case, a predetermined amount of the cleaning liquid 170 is previously injected onto the absorbing member 194 by the cleaning liquid injection pipe 164.

Figure 3B:
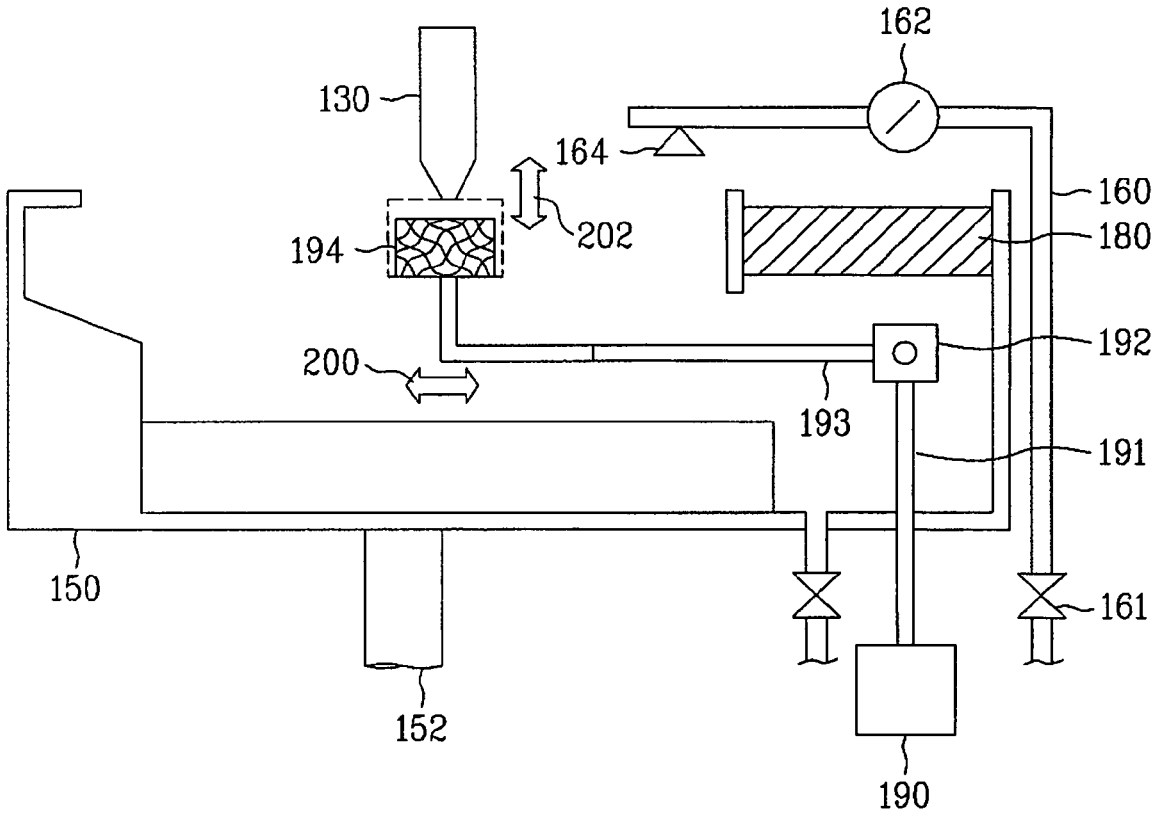

After that, as shown in FIG. 3B, the absorbing member 194 is vertically moved by a predetermined height and horizontally moved by a predetermined distance, as shown by arrows 200 and 202, in accordance with operations of the first and second driving units 190 and 192 of the nozzle cleaning unit, thereby cleaning the pollutant material 132 from the nozzle 130.

Figure 3C:
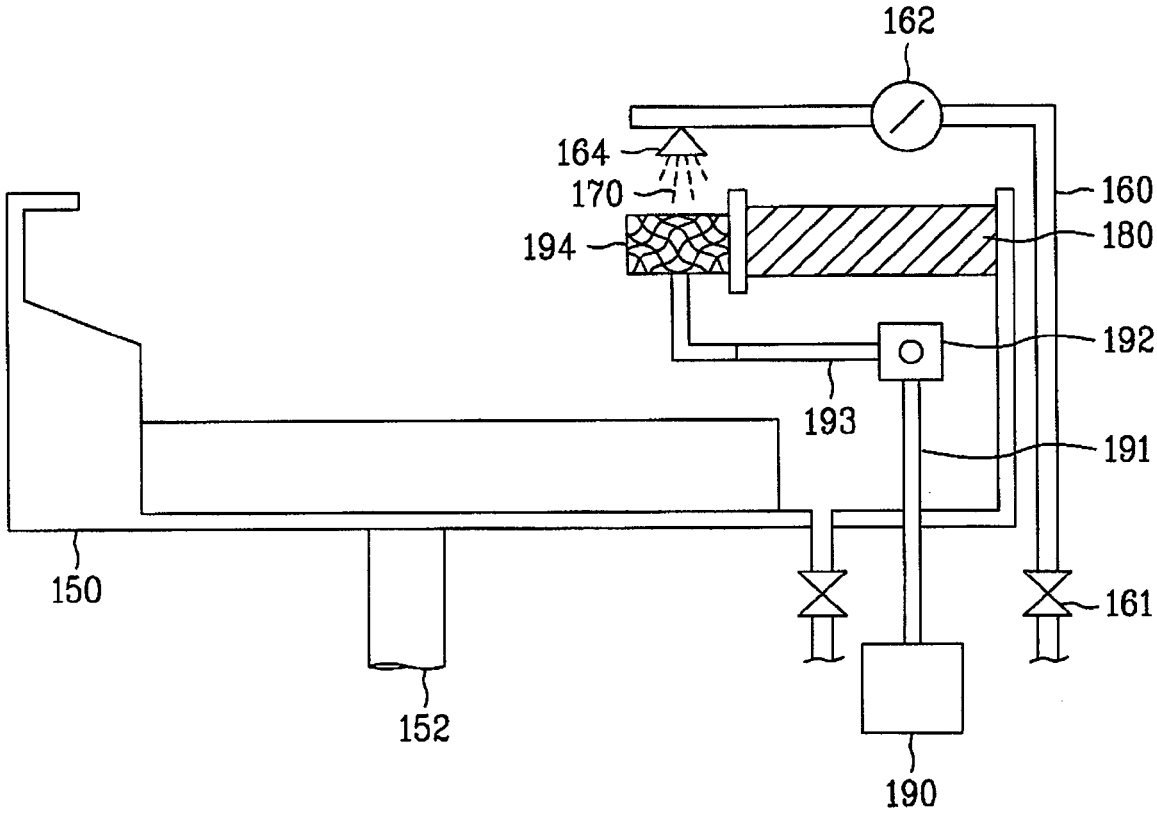

In succession, as shown in FIG. 3C, the absorbing member 194, which is polluted by the pollutant material 132, is moved to the compression block 180 of the absorbing member cleaning unit in accordance with operation of the driving shaft 193. If the polluted absorbing member 194 comes into contact with the compression block 180, a predetermined amount of the cleaning liquid 170 is injected onto the polluted absorbing member 194 from the cleaning liquid injection pipe 164.

Figure 3D:
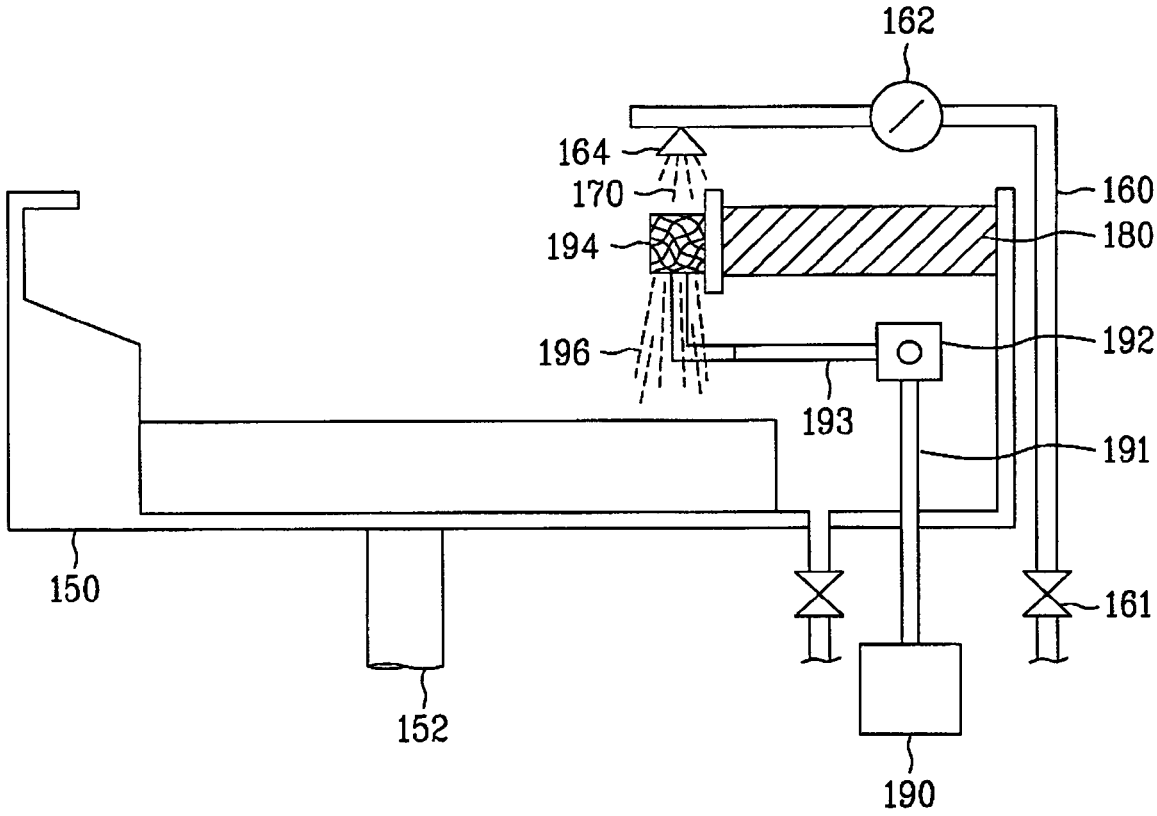

Finally, as shown in FIG. 3D, the polluted absorbing member 194 is compressed by the compression block 180 in accordance with operation of the driving shaft 193. As a result, the polluted absorbing member 194 is cleaned by the cleaning liquid 170 injected thereto when being compressed by the compression block 180. The polluted cleaning liquid 196 is discharged from the polluted absorbing member 194 when the absorbing member 194 is compressed. The discharged cleaning liquid 196 is stored in the storage space of the gantry 150 to thereby be discharged through the discharge pipe.

When the polluted absorbing member 194 is cleaned by the absorbing member cleaning unit, the nozzle 130, which is completely cleaned, is returned to the rotary type coating apparatus or dispensing apparatus for performing a relevant process.

Meanwhile, the nozzle, as being used in the nozzle cleaning apparatus and method in accordance with the embodiment of present invention, is explained, for example, as a constituent element of the rotary type coating apparatus or dispensing apparatus, but is not limited thereto. It will be appreciated that the nozzle may be a nozzle to be used in the formation of black matrices, color filters (or phosphors), column spacers, liquid crystals, and sealants during the manufacture of liquid crystal displays.

As apparent from the above description, with the apparatus and method for cleaning a nozzle according to the above described embodiment of the present invention, the polluted nozzle is able to be cleaned by use of an absorbing member and in turn, the polluted absorbing member is able to be cleaned by use of cleaning liquid, whereby the automatic cleaning of the nozzle can be accomplished. Automatic cleaning of the polluted nozzle has the effect of reducing cleaning labor and time, and improving productivity.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A method for cleaning a nozzle, comprising:

transferring a nozzle, which is in a polluted state, to a cleaning position;

cleaning a pollutant material from the nozzle by using an absorbing member; and cleaning the absorbing member, which is polluted while cleaning the pollutant material from the nozzle;

wherein the cleaning of the pollutant material from the nozzle includes sensing the cleaning position of the nozzle, transferring the absorbing member to the cleaning position using a first driving unit, a lift to cooperate with the first driving unit, a second driving unit mounted on the lift, and a driving shaft to cooperate with the second driving unit so as to move the absorbing member, and cleaning the pollutant material from the nozzle by moving the absorbing member both vertically and horizontally using the first and second driving unit.

2. The method as set forth in claim 1, wherein the absorbing member is made of sponge.

3. The method as set forth in claim 1, wherein the cleaning of the absorbing member includes:

moving the absorbing member, which is polluted while cleaning the pollutant material from the polluted nozzle, to a compression block;

injecting a cleaning liquid to the absorbing member when the absorbing member comes into contact with the compression block; and cleaning the absorbing member while compressing the absorbing member by the compression block.

4. The method as set forth in claim 3, wherein the cleaning liquid is a volatile material.

5. The method as set forth in claim 1, wherein the pollutant material from the nozzle is any one of a material for forming black matrices or column spacers, liquid crystals, sealant, and photoresist.

* * * * *